US006187173B1

(12) United States Patent
Chapus et al.

(10) Patent No.: US 6,187,173 B1
(45) Date of Patent: Feb. 13, 2001

(54) PROCESS FOR PURIFICATION OF RAW GASOLINE FROM CATALYTIC CRACKING

(75) Inventors: Thierry Chapus, Paris; Blaise Didillon, Rueil Malmaison; Christian Marcilly, Houilles; Charles Cameron, Paris, all of (FR)

(73) Assignee: Institut Francais du Petrole, Rueil Malmaison Cedex (FR)

( * ) Notice: Under 35 U.S.C. 154(b), the term of this patent shall be extended for 0 days.

(21) Appl. No.: 08/935,896

(22) Filed: Sep. 23, 1997

(30) Foreign Application Priority Data

Sep. 24, 1996 (FR) ..... 96 11692

(51) Int. Cl.[7] ..... C10G 67/00

(52) U.S. Cl. ..... 208/97; 208/100; 208/57; 208/189; 208/203; 208/204; 585/259; 585/260

(58) Field of Search ..... 208/97, 100, 57, 208/189, 203, 204; 585/259, 260

(56) References Cited

U.S. PATENT DOCUMENTS

| | | | | |
|---|---|---|---|---|
| 2,405,935 | * | 8/1946 | Anderson, Jr. et al. | 208/69 |
| 2,795,531 | * | 6/1957 | Meguerian et al. | 208/204 |
| 4,490,481 | * | 12/1984 | Boitiaux et al. | 502/330 |
| 4,533,779 | * | 8/1985 | Boitiaux et al. | 585/259 |
| 4,824,818 | * | 4/1989 | Bricker et al. | 502/163 |
| 4,897,180 | * | 1/1990 | Bricker et al. | 208/189 |
| 5,413,696 | * | 5/1995 | Fletcher et al. | 208/89 |
| 5,591,323 | * | 1/1997 | Marcilly et al. | 208/207 |
| 5,595,634 | * | 1/1997 | Hearn et al. | 203/23 |
| 5,597,476 | * | 1/1997 | Hearn et al. | 208/208 R |
| 5,759,386 | * | 6/1998 | Frey | 208/217 |
| 5,851,383 | * | 12/1998 | Frey | 208/217 |
| 5,865,989 | * | 2/1999 | Cooper et al. | 208/203 |

FOREIGN PATENT DOCUMENTS

| | | |
|---|---|---|
| 1 470 487 | 12/1968 | (DE) . |
| 0 638 628 | 2/1995 | (EP) . |
| 0 685 552 | 12/1995 | (EP) . |
| 1 565 754 | 4/1980 | (GB) . |

* cited by examiner

*Primary Examiner*—Walter D. Griffin
*Assistant Examiner*—Nadine Preisch
(74) *Attorney, Agent, or Firm*—Millen, White, Zelano & Branigan, P.C.

(57) ABSTRACT

A process and apparatus for treating raw gasoline from catalytic cracking to obtain gasoline with the qualities required for use as motor fuel comprises selective hydrogenation followed by stabilization and optional cooling of the effluent, then sweetening followed by degassing to obtain a dedienized, stabilized and sweetened gasoline. The hydrogenation catalyst preferably comprises 0.1–1% of palladium deposited on a support, sweetening is preferably carried out on a solid catalyst containing an aluminosilicate of an alkali metal (for example sodalite), a metal chelate and activated charcoal. The product from this process can be placed directly in the gasoline pool or, advantageously, fractionated to obtain one or more cuts which can be used as feeds for etherification.

17 Claims, 2 Drawing Sheets

$H_2$
2
$O_2$
7
6
1
3
4
5
8
9
10
$H_2O$
11
12
13

PROCESS FOR PURIFICATION OF RAW GASOLINE FROM CATALYTIC CRACKING

FIELD OF THE INVENTION

The invention concerns a process and apparatus for the purification of raw gasoline from catalytic cracking.

BACKGROUND OF THE INVENTION

The production of reformulated gasoline satisfying new environmental regulations requires, in particular, a reduction in the concentration of olefins and/or aromatics (especially benzene), also sulphur, and particularly mercaptans.

As an example, the presence of diolefins in catalytic cracking gasolines risks the formation of gums which mean that such raw gasolines are difficult to use as a fuel.

The diolefins must therefore be eliminated before etherification.

We have already developed a process for selective hydrogenation of a catalytic cracking gasoline which eliminates diolefins and which consists of bringing the feed into contact with a catalyst containing 0.1–1% of palladium deposited on a support. Such a process is described in European patent EP-A-0 685 552.

Further, oxidizing sweetening is a reaction which is well suited to ensuring that malodorous compounds in catalytic cracking gasolines do not pass into the gasoline pool.

A sweetening process has been described in EP-A-0 638 628 which consists of bringing the cut to be treated into contact, in the presence of air, with a catalyst comprising an alkaline aluminosilicate, activated charcoal and a metal chelate.

Unfortunately, when gasolines which contain a large quantity of mercaptans (at least 120 ppm) are treated, in order to obtain a mercaptan level which satisfies the regulations, low space velocities or large quantities of catalyst must be used, or a plurality of sweetening reactors must be used. These constraints are highly problematic for the operator.

SUMMARY OF THE INVENTION

We have, therefore, developed a process which can overcome these disadvantages and which also improves the service life of the sweetening catalyst.

More precisely, in the process of the invention the feed (catalytic cracking gasoline) containing dienic and/or acetylenic impurities and mercaptans, undergoes selective hydrogenation, the effluent obtained is stabilized then undergoes sweetening, and the gasoline obtained is degassed.

The process of the present invention has a number of advantages:

- reduction of the diolefin concentration to less than 3000 ppm, preferably 2500 ppm and more preferably 1500 ppm;
- displacement of the double bond in some branched olefins, for example 4-methylpentene-1 to 2-methylpentene-2, thus increasing the quantity of etherifiable olefins;
- sweetening by a catalytic reaction between mercaptans and diolefins leading to the formation of sulphides, or by an oxidising catalytic reaction to convert mercaptans to disulphides, the sulphides and disulphides being readily eliminated;
- when the selective hydrogenation step is operated at a temperature of 80° C. or more and the sweetening step is preferably carried out at 80° C. or less, there is good thermal integration in the process;
- the selective hydrogenation temperature is controlled by recycling a portion of the sweetening effluent (dedienized, sweetened and cooled gasoline) to the selective hydrogenation step.

The invention also concerns an apparatus for carrying out the process of the invention for the purification of catalytic cracking gasolines containing dienic and/or acetylenic impurities, and mercaptans, said apparatus comprising at least one selective hydrogenation reactor containing at least one fixed catalyst bed, and having at least one line for introducing a feed, at least one effluent outlet line, and a line supplying hydrogen to the reactor, said reactor being followed by at least one stabilization drum connected to said effluent outlet line, the drum having at least one gas outlet line and at least one stabilized effluent outlet line, and said effluent passing into at least one sweetening reactor comprising at least one effluent inlet line and at least one effluent outlet line, said reactor having close thereto at least one oxidizing agent supply line, said apparatus also comprising at least one drum for degassing the effluent from the sweetening reactor, said drum having at least one gas outlet line and at least one outlet line for dedienized, stabilized and sweetened gasoline.

This integrated process can also reduce the investment required compared with conventional processes, since:

- the two reactors can be operated without the need for additional pumps, with the exception of the recycling pump when necessary;
- the reduction in the mercaptan content as early as in the selective hydrogenation reactor can considerably reduce the size of the sweetening reactor.

BRIEF DESCRIPTION OF THE DRAWINGS

The description of the process and apparatus will be better understood from FIGS. 1 and 2. They are schematic flowsheets provided for ease of explanation and only represent implementations of the invention.

DETAILED DESCRIPTION OF THE DRAWINGS

Figure 1:
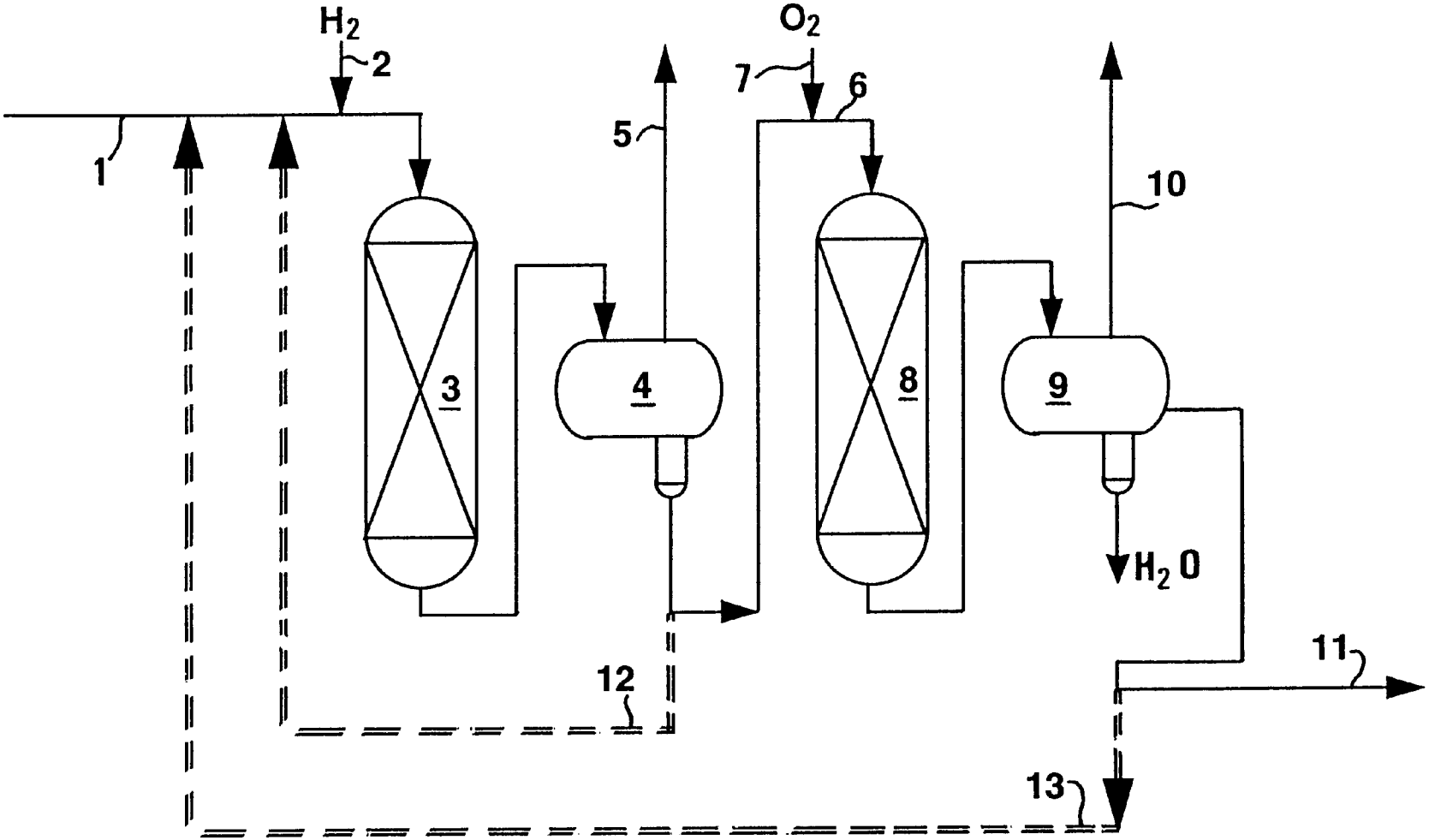

The feed enters treatment 3 via line 1 where it undergoes selective hydrogenation in the presence of hydrogen.

The selective hydrogenation step allows selective hydrogenation of diolefins to the corresponding olefins while isomerising primary and secondary olefins to tertiary olefins, for example isomerising 3-methylbutene-1, which is not etherifiable, to etherifiable 2-methylbutene-2, and which can also partially sweeten the catalytic cracking gasoline to obtain a product with a mercaptan content which is lower by at least 10%, and even less than 50% with respect to the feed.

Selective hydrogenation of FCC raw gasolines preferably consists of bringing the cut into contact with a catalyst comprising 0.1 to 1% of palladium deposited on a support at a pressure of 4–50 bar, at a temperature of 50–250° C., deposited on an inert support such as alumina, silica, silica-alumina, at a liquid hourly space velocity (LHSV) of 1 to 10 $h^{-1}$.

The catalyst comprises nickel (1–20% by weight, preferably 5–15% by weight) or, as is preferably, palladium (0.1% to 1% by weight, preferably 0.2% to 0.5% by weight), deposited on an inert support such as alumina, silica, or silica-alumina, or a support containing at least 50% of alumina.

Another metal can be associated with the palladium to form a bimetallic catalyst, for example nickel (1–20% by weight, preferably 5–15% by weight) or gold (Au/Pd of 0.1 or more and less than 1 by weight, preferably in the range 0.2 to 0.8).

The choice of operating conditions is particularly important. Most generally, the process is carried out under pressure in the presence of a quantity of hydrogen which is in slight excess with respect to the stoichiometric value required to hydrogenate the diolefins. The hydrogen and the feed to be treated are injected as upflows or downflows into the reactor, which preferably has a fixed catalyst bed. The temperature is most generally in the range 50° C. to 200° C., in particular in the range 80° C. to 200° C. and preferably in the range 150° C. to 170° C.

The pressure is sufficient to maintain more than 80% by weight, preferably more than 95% by weight, of the gasoline to be treated in the liquid phase in the reactor, most generally between 4 and 50 bar, preferably above 10 bar. A pressure in the range 10–30 bar, preferably in the range 12–25 bar, is advantageous.

Under these conditions, the space velocity is 1–10 $h^{-1}$, preferably in the range 4–10 $h^{-1}$.

The catalytic cracking gasoline cut generally contains 15% to 50% of olefins (olefins, diolefins and cycloolefins). After hydrogenation, the diene content is reduced to less than 3000 ppm, preferably to less than 2500 ppm, more preferably to less than 1500 ppm and still more preferably to less than 500 ppm. The diene content in the $C_5$ and $C_6$ cuts after selective hydrogenation can generally be reduced to less than 250 ppm.

The particular hydrogenation conditions mean that it can be carried out directly downstream of a catalytic cracking gasoline debutanizer or depropanizer without the need for pre-heating or for a booster pump.

Hydrogen is supplied to the hydrogenation reactor, for example to the feed (FIG. 1, via line 2) or in part directly into the reactor (FIG. 2, for example), or it can all be supplied to the reactor.

Figure 2:
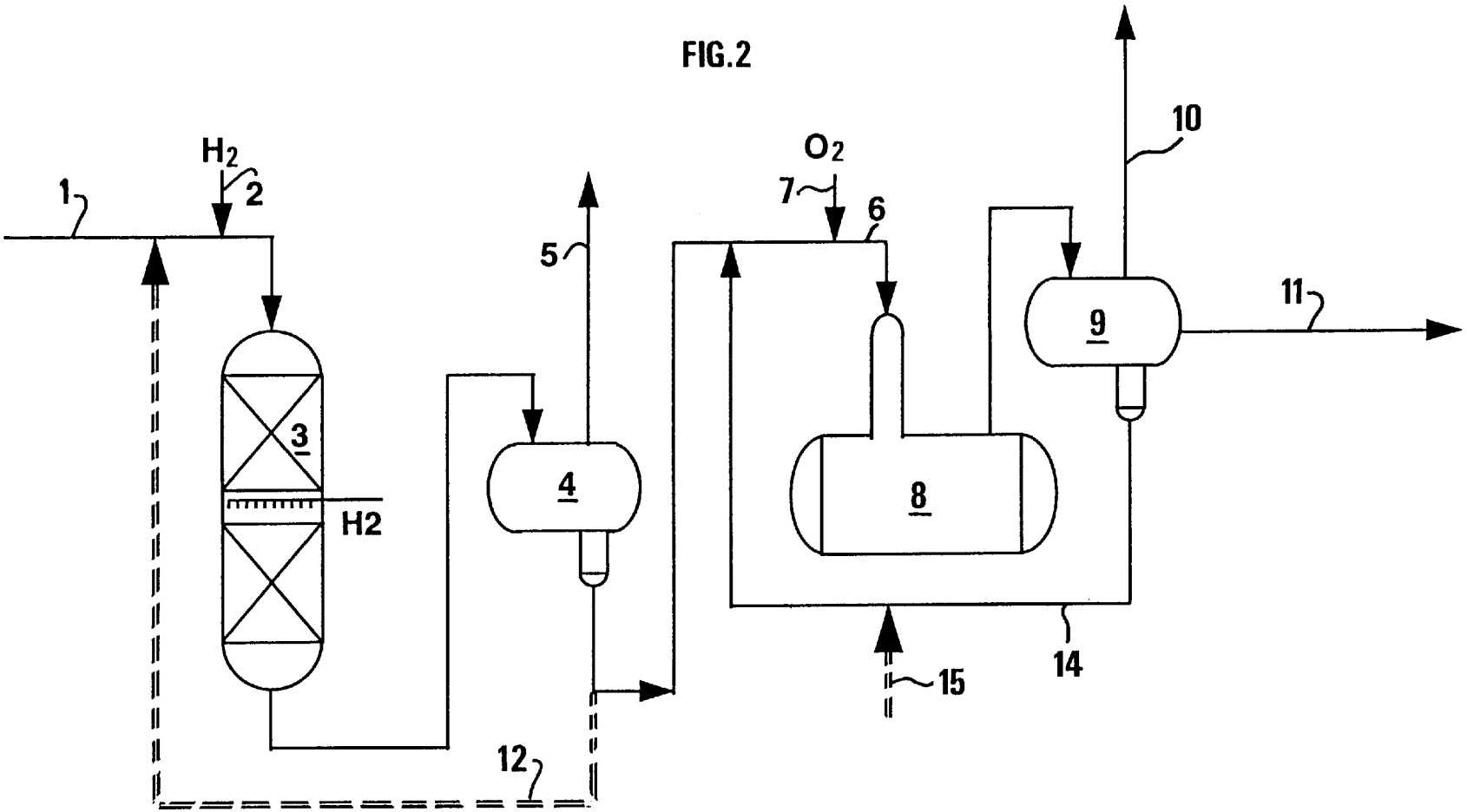

In a preferred embodiment of the invention, the catalytic hydrogenation reactor 3 is arranged in a particular fashion as shown in FIG. 2, namely in two catalytic zones, the first being traversed by the liquid feed (and a quantity of hydrogen which is smaller than the required stoichiometry for converting all of the diolefins to mono-olefins), the second receiving the liquid feed from the first zone (and the rest of the hydrogen, i.e., a quantity of hydrogen sufficient to convert the remaining diolefins to mono-olefins and to isomerise at least a portion of the primary and secondary olefins to tertiary olefins), for example injected via a lateral line and dispersed using a suitable diffuser.

The proportion (by volume) of the first zone is at most 75% of the sum of the sum of the 2 zones, preferably 15% to 30%.

Unused hydrogen is degassed from the effluent obtained, in stabilization drum 4. The gases are extracted via line 5.

At least a portion of the degassed gasoline is then brought to the temperature of the oxidizing sweetening operation (cooled, for example), allowing heat to be recovered. In an advantageous embodiment, a portion of the gasoline obtained from drum 4 is recycled via line 12 to the feed entering the selective hydrogenation step, this gasoline preferably not being cooled.

The gasoline sweetening step consists of catalytic oxidation of the mercaptans contained therein to disulphides.

This step is carried out in a reactor 8 into which gasoline arrives via line 6, also the oxidizing agent.

In a first variation, catalytic oxidation of mercaptans to disulphides can be carried out by a simple soda wash, i.e., by mixing the gasoline to be treated with an aqueous solution of an alkaline base such as sodium hydroxide, to which a catalyst based on a metal chelate (cobalt phthalocyanine, for example) is added in the presence of an oxidizing agent.

When the mercaptan content in the gasoline is high, a fixed bed of supported catalyst is preferably used, in the presence of an alkaline base and an oxidizing agent. The alkaline base which is normally used is an aqueous sodium hydroxide solution; it is introduced into the reaction medium either continuously or intermittently, to maintain the alkalinity and the aqueous phase necessary for the oxidation reaction. The oxidizing agent, generally air, is advantageously mixed with the gasoline cut to be sweetened, via line 7. The metal chelate used as the catalyst is generally a metal phthalocyanine such as cobalt phthalocyanine. The reaction takes place at a pressure which is in the range 1 to 30 bar, at a temperature which is in the range 20° C. to 100° C., preferably 20° C. to 80° C. The exhausted caustic soda solution is renewed because of impurities from the feed and because of the variation in the concentration of the base which reduces as water is added by the feed and the mercaptans are transformed into disulphides.

In a second, preferred, variation, the alkaline base can be incorporated into the catalyst by introducing an alkaline ion into the mixed oxide structure constituted essentially by combined aluminium and silicon oxides.

Alkali metal aluminosilicates are advantageously used, more particularly those of sodium and potassium, characterized by an Si/Al atomic ratio in the structure which is 5 or less (i.e., an $SiO_2/Al_2O_3$ molar ratio which is 10 or less) and which are intimately associated with activated charcoal and a metal chelate and having optimum catalytic performances for sweetening when the degree of hydration of the catalyst is in the range 0.1% to 40%, preferably in the range 1% to 25% by weight thereof. In addition to superior catalytic performances, these alkaline aluminosilicates have the advantage of a very low solubility in aqueous media, allowing their prolonged use in the hydrated state for the treatment of petroleum cuts to which a little water is regularly added or, optionally, an alkaline solution.

This sweetening step (preferably carried out in a fixed bed) for the gasoline containing mercaptans, from the first step, can thus be defined as comprising contact of the (stabilized) gasoline to be treated in contact with a porous catalyst under oxidation conditions. Preferably, in accordance with EP-A-0 638 628, it comprises 10% to 98%, preferably 50% to 95% by weight, of at least one solid mineral phase constituted by an alkaline aluminosilicate having an Si/Al atomic ratio of 5 or less, preferably 3 or less, 1% to 60% of activated charcoal, 0.02% to 2% by weight of at least one metal chelate and 0 to 20% by weight of at least one mineral or organic binder. This porous catalyst has a basicity, determined in accordance with American standard ASTM 2896, of more than 20 milligrams of potassium per gram and a total BET surface area of more than 10 $m^2/g$, and contains a permanent aqueous phase in its porosity which represents 0. 1% to 40%, preferably 1% to 25%, by weight of the dry catalyst.

A large number of basic mineral aluminosilicate type phases (principally sodium and/or potassium) which are particularly suitable can be cited:

When the alkali is mainly potassium:

kaliophilite: $K_2O$, $Al_2O_3$, $SiO_2$ (1.8<<2.4);

a feldspathoid known as leucite: $K_2O$, $Al_2O_3$, $SiO_2$ (3.5<<4.5)

zeolites:

philipsite: (K, Na)O, $Al_2O_3$, $SiO_2$ (3.0<<5.0);

erionite or offretite: (K, Na, Mg, Ca)O, $Al_2O_3$, $SiO_2$ (4<<8);

mazzite or omega zeolite: (K, Na, Mg, Ca)O, $Al_2O_3$, $SiO_2$ (4<<8);

L zeolite: (K, Na)O, $Al_2O_3$, $SiO_2$ (5<<8).

when the alkali is sodium:

amorphous sodium aluminosilicates with a crystalline organisation which cannot be detected by X ray diffraction and in which the Si/Al atomic ratio is 5 or less, preferably less than 3;

sodalite $Na_2O$, $Al_2O_3$, $SiO_2$ (1.8<<2.4); sodalite can contain different alkaline salts or ions in its structure, such as $Cl^-$, $Br^-$, $ClO_3^-$, $BrO_3^-$, $IO_3^-$, $NO_3^-$, $OH^-$, $CO_3^-$, $SO_3^-$, $CrO_4^-$, $MoO_4^-$, $PO_4^-$, etc . . . , in the form of alkaline salts, principally of sodium. These different varieties are suitable for use in the present invention. Preferred varieties for use in the present invention are those containing the $OH^-$ ion in the form of NaOH and the $S^-$ion in the form of $Na_2S$;

nepheline $Na_2O$, $Al_2O_3$, $SiO_2$ (1.8<<2.4);

analcime, natrolite, mesolite, thomsonite, clinoptilolite, stilbite, Na-P1 zeolite, dachiardite, chabasite, gmelinite, cancrinite, faujasite comprising X and Y synthetic zeolites, and A zeolite type tectosilicates.

The alkaline aluminosilicate is preferably obtained by reaction of at least one clay (kaolinite, halloysite, montmorillonite, etc . . . ) in an aqueous medium with at least one compound (hydroxide, carbonate, acetate, nitrate, etc . . . ) of at least one alkali metal, in particular sodium and potassium, the compound preferably being the hydroxide, followed by heat treatment at a temperature between 90° C. and 600° C., preferably between 120° C. and 350° C.

The clay can also be heat treated and ground before being brought into contact with the alkaline solution. Thus kaolinite and all of its thermal transformation products (meta-kaolin, inverse spinel phase, mullite) can be used in the process of the invention.

When the clay is kaolin, kaolinite and/or meta-kaolin constitute the preferred basic chemical reactants.

Regarding the metal chelate, any chelate used in the prior art for this purpose can be deposited on the support, in particular metal phthalocyanines, porphyrines or corrins. Cobalt phthalocyanine and vanadium phthalocyanine are particularly preferred. The metal phthalocyanine is preferably used in the form of a derivative of the latter, with a particular preference for commercially available sulphonates, such as the mono- or disulphonate of cobalt phthalocyanine and mixtures thereof.

The reaction conditions used to carry out this second variation of sweetening is characterized by the absence of an aqueous base, and a higher temperature and hourly space velocity. The conditions used are generally as follows:

Temperature: 20° C. to 100° C., preferably 20° C. to 80° C.

Pressure: $10^5$ to $30\times10^5$ Pascal;

Quantity of oxidizing agent, air: 1 to 3 kg/kg of mercaptans;

hourly space velocity, VVH (volume of feed per volume of catalyst per hour): 1 to 10 $h^{-1}$ within the context of the process of the invention.

The water content in the alkaline based catalyst used in the oxidizing sweetening step of the present invention can vary during the operation in two opposing directions:

1) If the petroleum cut to be sweetened has been dried, it can gradually entrain and dissolved water present inside the porosity of the catalyst. Under these conditions, the water content of the latter regularly reduces and can thus drop below a limiting value of 0.1% by weight.

2) In contrast, if the petroleum cut to be sweetened is saturated with water and because the sweetening reaction is accompanied by the production of one molecule of water per molecule of disulphide formed, the water content of the catalyst can increase and reach values of more than 25% and in particular 40% by weight, which are values at which the catalyst performance deteriorates.

In the first case, water can be added to the petroleum cut upstream of the catalyst in sufficient quantities either continuously or discontinuously to maintain the desired internal degree of hydration, i.e., the water content of the support is kept between 0.1% and 40% by weight of the support, preferably between 1% and 25%.

In the second case, the temperature of the feed is fixed at a sufficient value, less than 80° C., to dissolve the water of reaction resulting from the transformation of the mercaptans to disulphides. The temperature of the feed is thus selected so as to maintain the water content of the support between 0.1% and 40% by weight of the support, preferably between 1% and 25% thereof.

This interval of predetermined water contents of the supports will depend, of course, on the nature of the catalytic support used during the sweetening reaction. We have established, in accordance with FR-A-2 651 791, that while a number of catalytic supports are capable of being used without aqueous sodium hydroxide (or without base), their activity only manifests itself when their water content (also known as the degree of hydration of the support) is kept within a relatively narrow range of values, which varies depending on the supports, but is apparently linked to the silicate content of the support and to the structure of its pores.

Other sweetening processes can also be used, for example those using an adsorbent, a metal chelate, ammonia and a quaternary ammonium salt.

An effluent leaves the sweetening step which is advantageously degassed in as drum 9, the gases being extracted via a line 10.

In an advantageous embodiment, a portion of the gasoline obtained (after degassing and advantageously after cooling) is recycled via a line 13 to the feed entering the selective hydrogenation step.

In a further variation, the aqueous solution of alkaline base is separated from the gasoline after sweetening and is recycled to the sweetening reactor by a line 14. Fresh base can be added, for example via a line 15 opening into recycling line 14.

The gasoline produced in the process of the invention leaves the apparatus via line 11. It has been dedienized (quantity of dienes reduced), stabilized and sweetened.

One implementation of the invention will be described below, and is given by way of non limiting example, made with reference to the two accompanying Figures.

EXAMPLE 1

TABLE 1

| Properties of FCC raw gasoline | |
|---|---|
| Initial point | 20° C. |
| End point | 166° C. |
| Total S content | 228 ppm |
| S content in mercaptan form | 72 ppm |

TABLE 1-continued

| Properties of FCC raw gasoline | |
|---|---|
| Bromine number | 67 |
| MAV | 12 |
| Paraffins | 29.9% by weight |
| Mono-olefins and cyclo-olefins | 37.0% by weight |
| Diolefins and cyclo-diolefins | 1.4% by weight |
| Naphthenes | 9.1% by weight |
| Aromatics | 22.6% by weight |

An FCC raw gasoline, the composition of which is given in Table 1, was treated using the process of FIGS. 1 and 2 respectively.

100 $cm^3$ of LD265 catalyst from Procatalyse containing 0.3% by weight of palladium support on alumina was placed in a hydrogenation reactor.

The catalyst was activated by reduction in hydrogen at a flow rate of 30 l/h for 5 hours at 200° C. The apparatus was cooled under nitrogen to 150° C. before injecting FCC gasoline with the properties shown in Table 1. The reactor was then pressurized to 14 bar and the gasoline was injected into the bottom of the reactor at an HSV of 10 $h^{-1}$.

A quantity of hydrogen corresponding to a $H_2$/diolefins molar ratio of 1.4 was injected. The feed/hydrogen mixture traversed the catalytic bed as an upflow. The results obtained in the process of the invention are shown in Table 2.

A farther catalytic test was carried out using the scheme of FIG. 2. The catalytic zone was divided into two separate beds, with 25 $cm^3$ in the first zone and 75 $cm^3$ of LD265 in the second zone. The above procedure was used, except that the quantity of hydrogen injected into the reactor with the feed represented a molar ratio of 0.9. An injection apparatus between the two beds allowed a supplemental quantity of hydrogen corresponding to a molar ratio of 0.5 with respect to the quantity of diolefins initially present in the FCC raw gasoline to be added.

The effluent from the hydrogenation step was in each case completely stabilized and cooled if necessary, then sent in its totality to the sweetening reactor which contained a solid basic catalyst comprising a basic mineral aluminosilicate type phase which was a sodalite on a charcoal support, on which the metal chelate, a sulphonated cobalt phthalocyanine, was deposited. The reactor operated at 7 bar, at 40° C. The water content was kept between 1% and 25% by periodic injection of water. The HSV was 3 $h^{-1}$. A gasoline was obtained which, after degassing, had the composition shown in Table 3.

TABLE 2

Composition of effluents after hydrogenation according to FIG. 1 or 2

| | FIG. 1 | FIG. 2 |
|---|---|---|
| Initial point | 20° C. | 20° C. |
| End point | 169° C. | 170° C. |
| Total S content | 225 ppm | 227 ppm |
| S content in mercaptan form | 58 ppm | 20 ppm |
| Bromine number | 58 | 59 |
| MAV | <1 | <1 |
| Paraffins | 31.1% by weight | 31.0% by weight |
| Mono-olefins and cyclo-olefins | 36.9% by weight | 37.0% by weight |
| Diolefins and cyclo-diolefins | 0.0% by weight | 0.0% by weight |
| Naphthenes | 10.0% by weight | 10.0% by weight |
| Aromatics | 22.0% by weight | 22.0% by weight |

TABLE 3

| Composition of dedienized, stabilized and sweetened gasoline | |
|---|---|
| Initial point | 20° C. |
| End point | 170° C. |
| Total S content | 225 ppm |
| S content in mercaptan form | 0.5 ppm |
| Bromine number | 59 |
| MAV | <1 |
| Paraffins | 31.0% by weight |
| Mono-olefins and cyclo-olefins | 37.0% by weight |
| Diolefins and cyclo-diolefins | 0.0% by weight |
| Naphthenes | 10.0% by weight |
| Aromatics | 22.0% by weight |

EXAMPLE 2

The same apparatus as before (a single hydrogenation bed) and the same catalysts were used, but with a different feed.

Characteristics of Model Feed

10% isoprene
10% styrene
300 ppm pentane thiol
n-heptane

Characteristics of Effluent after Hydrogenation

Operating conditions: P 30 bar; HSV 3 $h^{-1}$

| T | 70° C. | 90° C. |
|---|---|---|
| Styrene conversion (% by weight)* | 47 | 94 |
| Isoprene conversion (weight %) | 58 | 96 |
| Total S content (ppm by weight) | 260 | 290 |
| S content in mercaptan form (ppm by weight) | 22 | 14 |

* Conversion to ethylbenzene.

Characteristics of Effluent after Sweetening

Total S content (ppm by weight) 250
S content in mercaptan form (ppm by weight) 0.5

Thus the process of the invention is advantageous for the treatment of gasolines containing mercaptans and dienic and/or acetylenic impurities, and generally of feeds containing at least 50 ppm of mercaptans. It is particularly advantageous for mercaptan contents of at least 100 ppm, preferably 120 ppm or 150 ppm. It can also be used to treat feeds containing at least 200 ppm of mercaptans with performances regarding HSV or catalyst quantities which are of interest to the operator. In all cases, and even for high mercaptan contents (at least 120 ppm), the regulations are satisfied, in particular because of the use of a particular hydrogenation reactor (FIG. 2).

The preceding examples can be repeated with similar success by substituting the generically or specifically described reactants and/or operating conditions of this invention for those used in the preceding examples.

The entire disclosure of all applications, patents and publications, cited above and below, and of corresponding French application 96/11692, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the purification of a catalytic cracking gasoline cut containing dienic impurities, said process comprising subjecting the gasoline cut to a selective hydrogenation step, stabilizing the resultant hydrogenated effluents, subjecting the resultant stabilized cut to oxidative sweetening to convert the mercaptans to disulfides and degassing the resultant stabilized gasoline to provide a dedienized, stabilized and sweetened gasoline.

2. A process according to claim 1, in which selective hydrogenation is carried out using a catalyst containing 0.1–1% of palladium deposited on a support, at a pressure of 4–50 bar, at a temperature of 50–250° C., and with an hourly space velocity of 1–10 $h^{-1}$.

3. A process according to claim 2, in which the catalyst also contains 1–20% of nickel.

4. A process according to claim 2, in which the catalyst also contains gold in an Au/Pd (wt/wt) ratio of at least 0.1 and less than 1.

5. A process according to claim 1, in which sweetening is carried out at a temperature of 20–80° C., and at a pressure of 1–30 bar.

6. A process according to claim 1, in which sweetening is carried out by contacting the stabilized gasoline with a catalyst in the presence of an alkaline base and an oxidizing agent.

7. A process according to claim 6, in which the sweetening catalyst comprises at least one solid mineral phase constituted by an alkaline aluminosilicate, activated charcoal and at least one metal chelate.

8. A process according to claim 7, in which the sweetening catalyst comprises 10% to 98% of at least one solid mineral phase constituted by an alkaline aluminosilicate having an Si/Al atomic ratio of 5 or less, 1% to 60% by weight of activated charcoal, 0.02% to 2% by weight of at least one metal chelate and 0 to 20% by weight of at least one mineral or organic binder with a basicity, determined in accordance with American standard ASTM 2896, of more than 20 milligrams of potassium per gram and a total BET surface area of more than 10 $m^2/g$, and contains a permanent aqueous phase in its porosity which represents 0.1% to 40% by weight of the dry catalyst.

9. A process according to claim 1, in which a portion of the stabilized effluent is recycled to the selective hydrogenation step.

10. A process according to claim 1, in which a portion of the dedienized, stabilized and sweetened gasoline is recycled to the hydrogenation step so as to control the hydrogenation temperature.

11. A process according to claim 1, wherein said gasoline cut contains 15% to 50% of olefins.

12. A process according to claim 1, wherein the selective hydrogenation step is conducted with a slight excess of hydrogen with respect to the stoichiometric value required to hydrogenate the dienic compound, so as to reduce the diene content to less than 3000 ppm.

13. A process according to claim 1, wherein said selective hydrogenation is conducted in first and second catalytic zones, the first catalytic zone being traversed by said gasoline cut in the liquid phase with a quantity of hydrogen smaller than the required stoichiometry for converting all of the dienic compounds to monoolefins, the second catalytic zone receiving the resultant hydrogenated gasoline cut from the first catalytic zone with a quantity of hydrogen sufficient to convert remaining dienic compounds to monoolefins and to isomerize at least a portion of primary and secondary olefins to tertiary olefins.

14. A process according to claim 9, in which a portion of the dedienized, stabilized and sweetened gasoline is recycled to the hydrogenation step so as to control the hydrogenation temperature.

15. A process according to claim 1, wherein the selective hydrogenation step is conducted with a slight excess of hydrogen with respect to the stoichiometric value required to hydrogenate the dienic compounds, so as to reduce the diene content to less than 500 ppm.

16. A process according to claim 1, further containing acetylenic impurities.

17. A process according to claim 3, wherein the selective hydrogenation reaction is conducted at 50–200° C., 10–50 bars and 4–10 $h^{-1}$.

* * * * *